United States Patent [19]

Huart

[11] 4,260,284

[45] Apr. 7, 1981

[54] FILTER TUBE FOR DRAIN PURPOSES

[75] Inventor: Robert Huart, Soest, Netherlands

[73] Assignee: DHV Raadgevend Ingenieursbureau BV, Netherlands

[21] Appl. No.: 44,019

[22] Filed: May 31, 1979

[30] Foreign Application Priority Data

Jun. 7, 1978 [NL] Netherlands ..... 7806180

[51] Int. Cl.[3] ..... E02B 13/00; E02B 11/00

[52] U.S. Cl. ..... 405/43; 405/36; 405/50

[58] Field of Search ..... 405/50, 249, 248, 36, 405/37, 41, 51, 43, 44

[56] References Cited

U.S. PATENT DOCUMENTS

| | | | |
|---|---|---|---|
| 1,142,125 | 6/1915 | Sooy | 405/50 X |
| 3,522,708 | 8/1970 | Firman | 405/50 |
| 3,851,490 | 12/1974 | Matsushita | 405/248 |
| 4,110,989 | 9/1978 | Selkirk | 405/248 |

FOREIGN PATENT DOCUMENTS

| | | | |
|---|---|---|---|
| 166183 | 12/1955 | Australia | 405/36 |
| 674468 | 4/1966 | Belgium | 405/36 |
| 2323537 | 12/1973 | Fed. Rep. of Germany | 405/36 |
| 1050094 | 12/1966 | United Kingdom | 405/41 |
| 1385193 | 2/1975 | United Kingdom | 405/38 |

*Primary Examiner*—Dennis L. Taylor

*Attorney, Agent, or Firm*—Kane, Dalsimer, Kane, Sullivan and Kurucz

[57] ABSTRACT

A filter tube for drain purposes provided with openings debouching at its outer surface, said openings being adapted to be connected to a sub-atmospheric source through at least one discharge channel in the tube. At least one flush-channel is formed in the tube, which is fully separated from the discharge channel(s) and which is adapted to be connected to a source of pressure fluid at or adjacent the one tube end, while at or adjacent the other tube end an outlet for said pressure fluid is formed.

10 Claims, 3 Drawing Figures

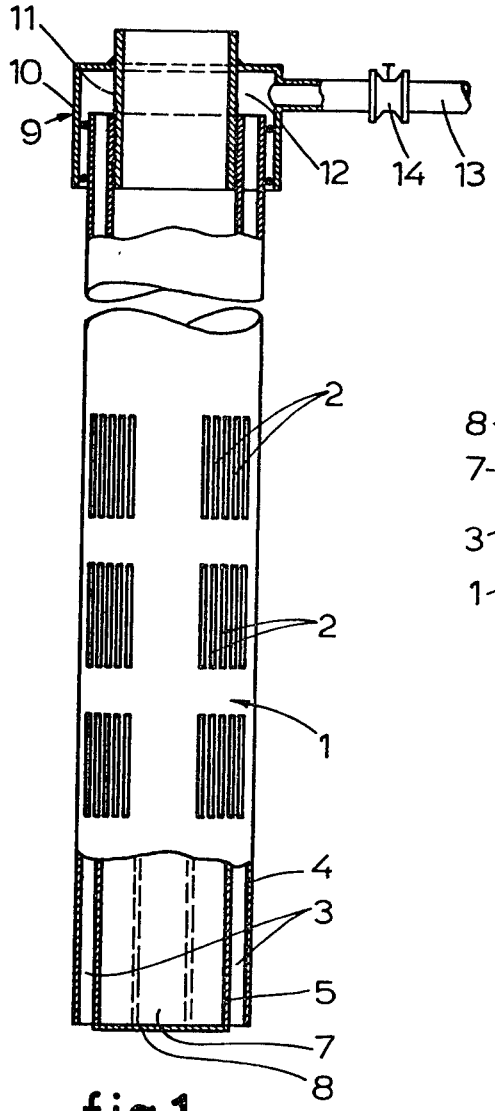
fig.1
fig.2
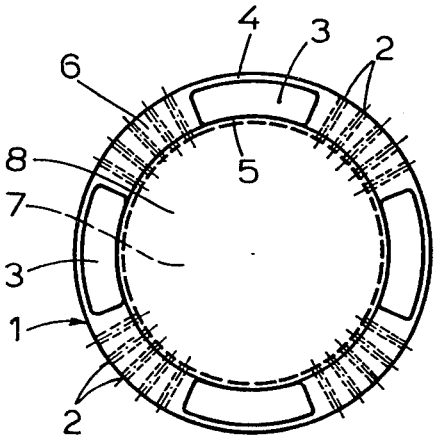
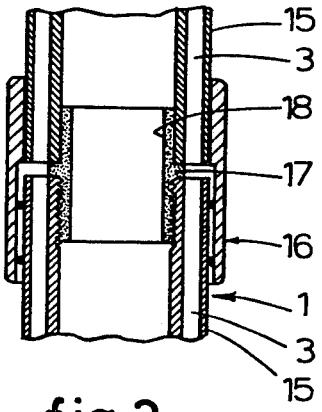
fig.3

FILTER TUBE FOR DRAIN PURPOSES

BACKGROUND OF THE INVENTION

The invention relates to a filter tube for drain purposes, provided with openings debouching at its outer surface, said openings being adapted to be connected to a sub-atmospheric source through at least one discharge channel in the tube.

According to a known method a hole is flushed in the ground by means of a flush-water pipe, whereafter a filter tube is positioned in this hole.

According to another known method a casing closed at the upper side by means of a screw cap and open at its lower side is connected to a source of a pressure fluid, such as water or air under pressure, whereafter this casing is flushed into the ground. Hereupon the screw cap of the casing is removed and a filter tube is positioned within the casing, whereafter the casing is lifted again, while the filter tube remains in the ground.

These known methods for positioning a filter tube in the ground have the disadvantage that a relatively large number of steps has to be taken, which are time consuming and costly.

SUMMARY OF THE INVENTION

It is an object of the present invention to provide a filter tube for drain purposes, which may be positioned in the ground in an extremely simple and quick manner.

For this purpose the filter tube according to the invention is characterized by at least one flush-channel in the tube, which is fully separated from the discharge channel(s), and which is adapted to be connected to a source of a pressure fluid at or adjacent the one tube end, while at or adjacent the other tube end an outlet for said pressure fluid is formed.

According to the invention neither a flushwater pipe, nor a casing is necessary due to the fact that the filter tube itself has at least one flush-channel for the supply of a pressure fluid.

In this manner the costs for positioning the filter tubes in the ground are decreased, while the lowering of the filter tubes into the ground can take place very rapidly.

BRIEF DESCRIPTION OF THE DRAWINGS

The invention will hereafter be further elucidated with reference to the drawings, which show an embodiment of a filter tube for drain purposes according to the invention by way of example.

FIG. 1 is a side view, partly in section, of an embodiment of a filter tube according to the invention.

FIG. 2 is a bottom view of the filter tube according to FIG. 1 at a larger scale.

FIG. 3 is a cross-section of a connection between two successive tube portions.

DESCRIPTION OF A PREFERRED EMBODIMENT

FIGS. 1 and 2 show an embodiment of a filter tube 1 for drain purposes, which is provided in at least its lower part with slot shaped perforations 2, which extend through the wall of the tube in the traverse direction. In the embodiment shown these slot shaped perforations 2 are arranged in groups and are divided over the circumference of the filter tube 1. Of course the perforations 2 may also have another shape, or may be arranged in a different manner.

Preferably the filter tube 1 is made of artificial material, such a polyvinylchloride.

One or more flush-channels 3 are formed within the wall of the tube and extend in the longitudinal direction of the tube 1. These flush-channels begin and end in the end faces of the tube 1. In the embodiment shown four flush-channels 3 are equally divided over the circumference of the tube, but of course it is possible to apply any other number of flush-channels.

Of course, as an alternative, the flush-channels 3 may extend in a direction which slightly differs from the longitudinal direction of the tube 1. As a further alternative the flush-channels 3 may begin and/or end at a slight distance from the end face and/or end faces of the tube 1.

When the filter tube 1 is to be lowered into the ground the flush-channels 3 are connected at the upper end of the tube to a source of a pressure fluid, such as water or air under pressure. This pressure fluid passes the channels 3 in the downward direction and debouches at the lower end of the tube, thereby loosening the ground underneath the tube 1. In this manner the lowering of the filter tube 1 into the ground is considerably facilitated and may take place with light-weight material.

According to the embodiment of FIGS. 1 and 2 the wall of the tube is integrally formed and includes two concentric wall portions 4, 5 and partitions 6. As an alternative the tube can also be assembled from concentric wall portions, while the partitions are integrally formed with one of said wall portions and extend until the other wall portion.

As shown in the drawings the perforations 2 in the wall of the tube are formed in the partitions 6 between successive flush-channels 3, so that these perforations 2 are fully separated from the flush-channels 3. The perforations 2 connect with the interior of the filter tube 1. In operation this interior of the filter tube 1 is directly connected to a source of sub-atmospheric pressure, such as the suction side of a pump, or, as an alternative, the interior of the filter tube 1 is connected to this source of sub-atmospheric pressure through a pipe (not shown), which extends downwardly through this interior over a considerable portion of the height of the filter tube 1 and which ends below the water level.

The interior of the filter tube 1 forms a discharge channel 7 and is closed at its lower side by a closure element 8 in order to prevent that earth may enter this channel 7 when the filter tube 1 is lowered into the ground, or in operation, when the source of sub-atmospheric pressure functions.

A connection head 9 may be mounted on the filter tube 1. In the embodiment shown this connection head 9 consists of an outer cap 10, which sealingly engages the exterior of the filter tube 1 and an inner pipe 11, which is sealingly screwed in this tube 1 and which passes an opening in the upper wall of the outer cap 10 and is connected therewith. A chamber 12 is formed within the outer cap 10 around the inner pipe 11. When the filter tube 1 is to be lowered into the ground this chamber 12 is connected to a source of a pressure fluid through a line 13, wherein a valve 14 is applied. When the filter tube 1 is in operation, the inner pipe 11 is connected to the suction side of a pump, or, as an alternative, the connection head 9 is removed and the discharge channel 7 is connected to this pump. Under certain circumstances it is necessary to use a pipe, which extends downwardly through the discharge channel 7 over a considerable portion of the height of the filter tube 1 and which ends below the water level, which pipe is connected to the pump and is passed by the water to be discharged.

The filter tube 1 may consist of tube portions 15, while successive tube portions 15 are sealingly connected to each other by means of a connecting element 16, as shown in FIG. 3.

A spacer member 17 is positioned between the end faces of successive tube portions 15. This spacer member 17 at least substantially uncovers the openings of the flush-channels 3 in the end faces of the tube portions 15. Due to the application of this spacer member 17 it is not necessary that the flush-channels 3 in the successive tube portions 15 are aligned with each other.

In the embodiment shown the spacer member 17 consists of a ring of resilient material, having a radial dimension, which is small with respect to the thickness of the wall of the tube and being integrally formed with an inner sleeve 18, which extends over some distance within both successive tube portions 15.

This inner sleeve 18 is connected, e.g. by means of glue, in the lower part of the upper tube portion 15 of the successive tube portions 15.

The inner sleeve 18 is provided with external screw-thread below the spacer member 17 and may be screwed into the upper part of the lower tube portion 15, which is provided with internal screw-thread.

The connecting element 16 may be made of metal or artificial material and is connected, e.g. by means of glue, to the upper tube portion 15 of the successive tube portions 15. Further this connecting element 16 is sealingly connected to the lower tube portion 15 by means of a closing mechanism.

According to the invention a filter tube 1 for drain purposes is provided, which makes it possible to flush a pressure fluid on the underlying ground when the filter tube 1 is lowered into the ground. In this manner the positioning of the filter tube 1 in the ground is considerably facilitated and may take place without the exertion of large forces.

The invention is not restricted to the embodiment shown in the drawings, which may be varied in several ways within the scope of the appended claims.

I claim:

1. A filter tube for drain purposes, comprising:
a tube;
openings debouching at the exterior surface of the tube;
a central discharge channel in the interior of the tube, said openings capable of being connected to a sub-atmospheric source through said central discharge channel;
at least one flush-channel formed in the wall of the tube and extending at least substantially in the longitudinal direction of the tube, said flush-channel being fully separated from the discharge channel and being able to be connected to a source of pressure fluid at or adjacent one tube end, said discharge channel, openings, and flush-channel arranged to allow simultaneous flushing via said flush-channel and draining through said openings into said central discharge channel; and
an outlet for said pressure fluid formed at the other end of the tube.

2. A filter tube according to claim 1 wherein said flush-channel is connected to a source of pressure fluid.

3. A filter tube for drain purposes, comprising:
a tube;
openings debouching at the exterior surface of the tube;
a central discharge channel in the interior of the tube, said openings capable of being connected to a sub-atmospheric source through said central discharge channel;
at least one flush-channel formed in the wall of the tube and extending at least substantially in the longitudinal direction of the tube, said flush-channel being fully separated from the discharge channel and being able to be connected to a source of pressure fluid at or adjacent one tube end;
an outlet for said pressure fluid formed at the other end of the tube; and
a connection head mounted on said one tube end, said connection head comprising an outer cap sealingly engaging the exterior surface of the tube and an inner pipe sealingly engaging the interior surface of the tube, said inner pipe being connected with the outer cap such that a chamber is formed therebetween which may be connected to a source of pressure fluid.

4. A filter tube according to claim 3, wherein a plurality of flush-channels are formed in the wall of the tube and are equally divided over the circumference of the tube.

5. A filter tube according to claim 3, wherein the discharge channel is closed at an end thereof opposite said connection head.

6. A filter tube according to claim 4, wherein the wall of the tube includes at least two concentric wall portions, while partitions extend between successive wall portions and laterally adjoin the flush-channels, the openings including perforations in the wall of the tube at the location of the partitions.

7. A filter tube according to claim 3, wherein this tube is assembled from tube portions, successive tube portions being sealingly connected to each other by means of a connecting element, a spacer member being positioned between the end faces of successive tube portions, which at least substantially uncovers these end faces.

8. A filter tube according to claim 7, wherein the spacer member comprising a ring having a radial dimension which is small with respect to the thickness of the wall of the tube, said ring being integrally formed with an inner sleeve, which extends over some distance within successive tube portions.

9. A filter tube according to claim 8, wherein the inner sleeve is connected, e.g. by means of glue, in a lower part of an upper tube portion of successive tube portions, while a part of the inner sleeve positioned underneath the spacer member is provided with external screw-thread, which co-operates with internal screw-thread in the upper part of a lower tube portion.

10. A filter tube according to claim 9, wherein the connecting element is connected, e.g. by means of glue, to the upper tube portion of successive tube portions and is sealingly connected to the lower tube portion by means of a closing mechanism.

* * * * *